US008629093B2

(12) United States Patent
Labeque et al.

(10) Patent No.: US 8,629,093 B2
(45) Date of Patent: Jan. 14, 2014

(54) DETERGENT COMPOSITION COMPRISING MIXTURE OF CHELANTS

(75) Inventors: Regine Labeque, Neder-over-Heenbeek (BE); Eugene Joseph Pancheri, Montgomery, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/873,401

(22) Filed: Sep. 1, 2010

(65) Prior Publication Data

US 2012/0053107 A1 Mar. 1, 2012

(51) Int. Cl.
*C11D 3/33* (2006.01)
*C11D 17/04* (2006.01)

(52) U.S. Cl.
USPC ..... 510/276; 510/296; 510/336; 510/338; 510/403; 510/404; 510/407; 510/416; 510/439; 510/480

(58) Field of Classification Search
USPC ..... 510/276, 296, 336, 338, 403, 404, 407, 510/416, 439, 480
See application file for complete search history.

(56) References Cited

U.S. PATENT DOCUMENTS

| | | | | |
|---|---|---|---|---|
| 2,220,099 | A | 11/1940 | Heidelberg et al. | |
| 2,477,383 | A | 7/1949 | Lewis | |
| 3,664,961 | A | 5/1972 | Norris | |
| 3,835,163 | A | 9/1974 | Rapko | |
| 3,923,679 | A | 12/1975 | Rapko | |
| 3,949,678 | A | 4/1976 | Theurer | |
| 4,102,903 | A | 7/1978 | Crutchfield et al. | |
| 4,105,827 | A | 8/1978 | Brichard et al. | |
| 4,120,874 | A | 10/1978 | Crutchfield et al. | |
| 4,158,635 | A | 6/1979 | Crutchfield et al. | |
| 4,222,905 | A | 9/1980 | Cockrell, Jr. | |
| 4,239,659 | A | 12/1980 | Murphy | |
| 4,246,612 | A | 1/1981 | Berry et al. | |
| 4,681,592 | A | 7/1987 | Hardy et al. | |
| 4,810,410 | A | 3/1989 | Diakun et al. | |
| 4,966,723 | A | 10/1990 | Hodge et al. | |
| 5,114,611 | A | 5/1992 | Van Kralingen et al. | |
| 5,227,084 | A | 7/1993 | Martens et al. | |
| 6,608,024 | B1 * | 8/2003 | DuVal et al. | 510/522 |
| 6,689,732 | B1 | 2/2004 | Guedira et al. | |
| 6,727,215 | B2 * | 4/2004 | Roberts et al. | 510/296 |
| 6,747,000 | B2 | 6/2004 | Pearce et al. | |
| 6,849,588 | B2 | 2/2005 | Elsik et al. | |
| 6,995,127 | B1 | 2/2006 | Smith et al. | |
| 7,008,914 | B2 | 3/2006 | Smith et al. | |
| 7,108,725 | B2 * | 9/2006 | Caswell et al. | 8/137 |
| 7,179,780 | B2 | 2/2007 | Forth et al. | |
| 7,329,441 | B2 | 2/2008 | Catlin et al. | |
| 7,595,290 | B2 | 9/2009 | Pounds et al. | |
| 7,677,015 | B2 | 3/2010 | Kroese et al. | |
| 7,786,027 | B2 | 8/2010 | Aouad et al. | |
| 2002/0137652 | A1 | 9/2002 | Gressel et al. | |
| 2003/0096726 | A1 | 5/2003 | Smith et al. | |
| 2003/0139312 | A1 * | 7/2003 | Caswell et al. | 510/320 |
| 2004/0186035 | A1 | 9/2004 | Johnston et al. | |
| 2006/0270582 | A1 | 11/2006 | Boeckh et al. | |
| 2007/0267444 | A1 * | 11/2007 | de Buzzaccarini et al. | 222/179.5 |
| 2008/0015135 | A1 * | 1/2008 | de Buzzaccarini et al. | 510/336 |
| 2009/0176935 | A1 | 7/2009 | Boeckh et al. | |
| 2009/0298735 | A1 | 12/2009 | Boeckh et al. | |
| 2010/0160201 | A1 * | 6/2010 | Scheuing et al. | 510/180 |
| 2010/0183533 | A1 | 7/2010 | Giles et al. | |
| 2010/0191012 | A1 | 7/2010 | Giles et al. | |
| 2010/0197961 | A1 | 8/2010 | Giles et al. | |
| 2010/0305020 | A1 | 12/2010 | Jennewein | |
| 2011/0061174 | A1 * | 3/2011 | Boutique et al. | 8/137 |
| 2011/0065624 | A1 * | 3/2011 | Boutique et al. | 510/296 |
| 2011/0111999 | A1 * | 5/2011 | Smets et al. | 510/119 |
| 2011/0155167 | A1 * | 6/2011 | Deconinck et al. | 132/208 |
| 2011/0171155 | A1 * | 7/2011 | Federle et al. | 424/70.24 |
| 2011/0306536 | A1 * | 12/2011 | Lant | 510/321 |

FOREIGN PATENT DOCUMENTS

| | | | |
|---|---|---|---|
| EP | 0482807 | A | 4/1992 |
| WO | WO 91/09932 | | 7/1991 |
| WO | WO 98/13467 | A1 | 4/1998 |
| WO | WO 99/02636 | A1 | 1/1999 |
| WO | WO 99/12040 | A1 | 3/1999 |
| WO | WO 2006/130442 | | 12/2006 |

OTHER PUBLICATIONS

Int'l Search Report 10 Pages, PCT/US2010/046716 dated Dec. 7, 2010.
U.S. Appl. No. 12/873,354, filed Sep. 1, 2010, Courchay.
U.S. Appl. No. 12/873,366, filed Sep. 1, 2010, Labeque.

* cited by examiner

*Primary Examiner* — Lorna M Douyon
(74) *Attorney, Agent, or Firm* — Melissa G. Krasovec; Steven W. Miller

(57) ABSTRACT

The present application relates to a compact liquid detergent composition comprising a mixture of chelants suitable for use in laundry cleaning.

5 Claims, No Drawings

DETERGENT COMPOSITION COMPRISING MIXTURE OF CHELANTS

TECHNICAL FIELD

The present invention relates to a compact liquid detergent used in laundry cleaning comprising a mixture of chelants.

BACKGROUND TO THE INVENTION

Chelants are often formulated in detergents because of the presence of metal ions, which can be detrimental to end performance. Many highly colored stains incorporate metals. Removal of the metal can often decolorize the stain and/or make it easier to remove by destabilizing its structure. Metal ions can also catalytically decompose bleach in a formulation leading to a significantly reduced performance. Especially transition metal radical ions e.g. Fe, Cu and Mn can accelerate bleach and peroxide decomposition during washing and bleaching. Water hardness ions e.g. Ca and Mg can also cause adverse interaction with surfactants used in washing formulations and lead to a reduction in the effective concentration available. Fatty acids can precipitate as calcium soaps resulting in the formation of soap scum.

Chelants are widely used chemicals that control adverse effects of metal ions in detergent products by chelating the metal. The chelants are often organic compounds, which form multiple bonds with a single metal ion. Chelants can be introduced into the detergent in an acid form or in a salt form; normally the salt form increases the water-solubility of the chelant. However sodium ions will interact with the fatty acids of the detergent composition resulting in the formation of solid soap. Therefore chelants need to be formulated into the composition containing as small amount of sodium ions as possible, nevertheless maintaining the solubility of the chelants. Another requirement for the chelants is their solubility. Selected chelants need to be soluble and stay soluble without the requirement of added water into the detergent composition. Additionally chelants need to be stable in solution during the storage.

Phosphate containing chelants have been used widely because of phosphates capability to sequester alkaline earth metals. However, due to legislation in various countries, level of phosphate in detergents needs to be substantially reduced. Alternatively detergent manufacturers are supply more phosphate free detergents. Therefore the detergent composition formulation needs to fulfill the requirements of regulatory requirements in different countries.

When formulating the compact liquid detergent composition the chelant needs to be selected to fulfill the criteria to control the metal ions, be soluble in the detergent composition, be stabile during the preparation and storage and fulfill the regulatory requirements.

In addressing these problems, the Applicant has surprisingly found that by combining chelants diethylene triamine pentaacetate (DTPA), in a sodium salt form with S,S-ethylene diamine disuccinic acid (EDDS) in a 2-amminoethanol neutralized form or in sodium salt form, the overall quantity of chelants can be decreased while maintaining good solubility and high activity level. Additionally the quantity of undesired sodium ions brought into the compact liquid detergent composition is reduced and therefore formation of undesired sodium soap is reduced. The compact liquid detergent composition of the present invention also covers wider regulatory requirements and can be used as global formulation.

Chelants are known for incorporation into cleaning compositions. For example, in WO2009/013534 (Innospec Limited) salt of ethylenediamine disuccinic acid (EDDS) is used to stabilize the hydrogen peroxide. In WO2009/013539 (Innospec Limited) magnesium salt of ethylenediamine disuccinic acid (EDDS) is used in detergent composition in water-soluble, non-hydroscopic solid form. In WO2009/013541 (Innospec Limited) a mixture of chelants 1-hydroxyethylidene-1,1-diphosphonic acid (HEDP) and ethylenediamine disuccinic acid (EDDS) is used in detergent compositions. In EP 1280882 (Procter & Gamble) chelants are used in liquid fabric softening compositions. In WO 01/83668 and WO 02/074893 (both Procter & Gamble) chelants have been used in detergent products.

SUMMARY OF THE INVENTION

A compact liquid detergent composition comprising less than 25% water by weight of the composition and a mixture of chelants, wherein first chelant is selected from the group consisting of sodium salt of Ethylenediamine-N,N'-disuccinic acid, Ethylenediamine-N,N'-disuccinic acid neutralized by 2-aminoethanol and mixtures thereof and second chelant is sodium salt of diethylene triamine pentaacetate. In some embodiments according to the present invention, the compact liquid detergent composition comprises a chelant mixture which comprises from 1:10 molar ratio of diethylene triamine pentaacetate and Ethylenediamine-N,N'-disuccinic acid or theirs salts to 10:1 molar ratio of diethylene triamine pentaacetate and Ethylenediamine-N,N'-disuccinic acid or their salts. In some embodiments of the present invention, the compact liquid detergent composition is encapsulated in a water-soluble pouch. In some embodiments, the water-soluble pouch comprises two or more compartments, wherein the second compartment comprises a coloring agent and does not comprise opacifier.

DETAILED DESCRIPTION OF THE INVENTION

The detergent product of the present invention is a compact liquid detergent suitable to be used in a water-soluble pouch, more preferably a multi-compartment water-soluble pouch or as a conventional liquid detergent conserved in containers. The water-soluble pouch, where present, comprises a water-soluble film and at least a first, and optionally a second compartment. The first compartment comprises a first composition, comprising a mixture of chelants. The second compartment comprises a second composition. Preferably the pouch comprises a third compartment and a third composition. The optionally second and third compositions are preferably visibly distinct from each other and the first composition.

Compact Liquid Detergent Composition

The composition of the present invention is a compact liquid. By the term 'liquid' it is meant to include liquid, paste, waxy or gel compositions. The liquid composition may comprise a solid. Solids may include powder or agglomerates, such as micro-capsules, beads, noodles or one or more pearlised balls or mixtures thereof. Such a solid element may provide a technical benefit, through the wash or as a pre-treat, delayed or sequential release component. Alternatively it may provide an aesthetic effect.

By the term 'compact' is meant to include liquid, paste, waxy or gel compositions which comprise less than 25% of water by the weight of the composition.

In a preferred embodiment the present composition is in the form of a water-soluble pouch, more preferably a multi-compartment pouch. The water-soluble pouch, wherein present, comprises a water-soluble film and at least a first, and optionally a second compartment. The first compartment comprises a first composition, comprising the mixture of chelants. The second compartment comprises a second, preferably different composition.

Chelants

The chelants are used in the present invention to control metal ion content, to stabilize bleach in washing solution and during storage and increase the stain removal by abstracting metal ions from the stains.

Chelants are molecules which form coordinate-covalent bonds with metal ions to form chelates. Chelates are coordination compounds in which a central metal atom bonds one or more atoms in at least one other molecule or ion called ligand such that at least one heterocyclic ring is formed with the metal ion as part of the each ring. Chelants are widely used in detergents, soaps, cleaning products and water treatment. Chelants are typically polyvalent molecules, usually aminocarboxylates having at least two binding site. The effectiveness of the chelants can be measured by measuring the binding constant with the various metals. Within limits, chelants are usually more effective at increasing wash solution pH, which prevents protonation of chelants.

The applicant has discovered that by combining chelants diethylene triamine pentaacetate (DTPA) in sodium salt form with S,S-Ethylenediamine-N,N'-disuccinic acid (EDDS) in 2-aminoethanol (MEA) neutralized form or in a sodium salt form, creates a synenergy between the chelants, and quantity of chelants can be decreased while maintaining high activity level and desired solubility. This permits more flexibility in formulation. Additionally the quantity of undesired sodium ions brought into compact liquid detergent composition is reduced. Reduced level of chelants improves the solubility and stability of chelants and permits the use of mixture of chelants in compact liquid detergent compositions. The compact liquid detergent composition of the present invention also covers wider regulatory requirements because the chelants do not contain any phosphates.

The chelants are preferably in the fully neutralized form; however the acid form or partially neutralized forms are encompassed in the invention.

EDDS is an effective chelating agent of transitional metals and heavy metals. Transitional metals may cause problems in compositions containing bleaching agents as they can cause decomposition of peroxide species. This may cause reduced bleaching performance and creation of hydroxyl radicals which can cause fibre damage and reduce product stability. EDDS has two stereogenic centers and therefore has three possible stereo isomers. The mixture of the chelants in a present invention may include any of the stereoisomers. Thus it may be selected from [R,R]-EDDS, [R,S]-EDDS, [S,S]-EDDS and any combinations thereof. Preferably the EDDS is present in substantially the [S,S]-form. Preferably at least 50%, more preferably at least 70% of the EDDS is of the [S,S] configuration. [S,S]-EDDS form of EDDS is biodegradable and therefore most preferred stereoisomer.

EDDS can be present in compact liquid detergent composition in sodium salt or MEA neutralied form, preferably in MEA neutralied form.

DTPA is an effective chelating agent of transitional metals and heavy metals. DTPA is a polyamino carboxylic acid consisting of a diethylenetriamine backbone modified with five carboxymethyl groups. DTPA is used as its conjugate base, which has a high affinity for metal cations.

DTPA can be present in a compact liquid detergent composition preferably DTPA in metal salt form. More preferably the DTPA is present in compact liquid detergent composition in the form of sodium salt comprising from 2 to 5 moles of sodium per mole of DTPA.

The chelants are added to the composition preferably in liquid form and they preferably stay in liquid form during preparation, storage and usage. DTPA is water-soluble in 1:2 ratio with sodium and EDDS is water-soluble in aminoethanol neurtalised form or in 1:2 ratio with sodium.

In a preferred embodiment the combination of chelants in the present invention comprises from ten moles of EDDS MEA neutralized form per one mole of DTPA sodium salt to one mole of EDDS MEA neutralized form per ten moles of DTPA sodium salt.

The composition of the present invention comprises mixture of chelants from 0.05% to 5% by weight of a composition, preferably from 0.1% to 4% by weight of the composition and most preferably from 0.5% to 2.0% by weight of the composition.

Optional Compact Liquid Detergent Composition Components

The compositions of the present invention may comprise one or more of the ingredients as discussed below.

Solvent System

The solvent system in the present compact liquid detergent compositions can be a mixture of organic solvents. The present composition does not contain any added water. High water content may have an unwanted effect on the film properties. Additionally too high or too low water content may have negative impact on detergent composition i.e. by causing phase separation. The water in the composition origins from the raw materials. Preferred organic solvents include 1,2-propanediol, ethanol, glycerol, dipropylene glycol, methyl propane diol and mixtures thereof. Other lower alcohols, $C_1$-$C_4$ alkanolamines such as monoethanolamine and triethanolamine, can also be used. Solvent systems can be absent, for example from anhydrous solid embodiments of the invention, but more typically are present at levels in the range of from 0.1% to 98%, preferably at least 1% to 50%, more usually from 5% to 25%.

Water is typically present at levels in the range from 5% to 25%, preferably from 7% to 20% more preferably from 8% to 15% by the weight of the compact liquid detergent composition.

Surfactants

The composition of the present invention may comprise surfactants, which are used in present invention as detersive surfactant for soil suspension purposes.

Surfactants utilized can be of the anionic, nonionic, zwitterionic, ampholytic or cationic type or can comprise compatible mixtures of these types. More preferably surfactants are selected from the group consisting of anionic, nonionic, cationic surfactants and mixtures thereof. Preferably the compositions are substantially free of betaine surfactants. Detergent surfactants useful herein are described in U.S. Pat. No. 3,664,961, Norris, issued May 23, 1972, U.S. Pat. No. 3,919,678, Laughlin et al., issued Dec. 30, 1975, U.S. Pat. No. 4,222,905, Cockrell, issued Sep. 16, 1980, and in U.S. Pat. No. 4,239,659, Murphy, issued Dec. 16, 1980. Anionic and nonionic surfactants are preferred.

Useful anionic surfactants can themselves be of several different types. For example, water-soluble salts of the higher fatty acids, i.e., "soaps", are useful anionic surfactants in the compositions herein. This includes alkali metal soaps such as the sodium, potassium, ammonium, and alkyl ammonium salts of higher fatty acids containing from 8 to 24 carbon atoms, and preferably from 12 to 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Additional non-soap anionic surfactants which are suitable for use herein include the water-soluble salts, preferably the alkali metal, and ammonium salts, of organic sulfuric reaction products having in their molecular structure an alkyl group containing from 10 to 20 carbon atoms and a sulfonic acid or sulfuric acid ester group. (Included in the term "alkyl" is the alkyl portion of acyl groups.) Examples of this group of synthetic surfactants are a) the sodium, potassium and ammonium alkyl sulfates, especially those obtained by sulfating the higher alcohols ($C_8$-$C_{18}$ carbon atoms) such as those produced by reducing the glycerides of tallow or coconut oil; b) the sodium, potassium and ammonium alkyl polyethoxylate sulfates, particularly those in which the alkyl group contains from 10 to 22, preferably from 12 to 18 carbon atoms, and wherein the polyethoxylate chain contains from 1 to 15, preferably 1 to 6 ethoxylate moieties; and c) the sodium and potassium alkylbenzene sulfonates in which the alkyl group contains from 9 to 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from 11 to 13, abbreviated as $C_{11}$-$C_{13}$ LAS.

Preferred nonionic surfactants are those of the formula $R^1(OC_2H_4)_nOH$, wherein $R^1$ is a $C_{10}$-$C_{16}$ alkyl group or a $C_8$-$C_{12}$ alkyl phenyl group, and n is from 3 to 80. Particularly preferred are condensation products of $C_{12}$-$C_{15}$ alcohols with from 5 to 20 moles of ethylene oxide per mole of alcohol, e.g., $C_{12}$-$C_{13}$ alcohol condensed with 6.5 moles of ethylene oxide per mole of alcohol.

The composition of the present invention comprises from 1% to 80% surfactant by weight of a composition. Surfactant is a component of the first composition. Preferably said first composition comprises from 5% to 50% surfactant by weight of composition. The second and third compositions, where present, may comprise surfactant at levels of from 0.1 to 99.9%.

When the selected surfactant is LAS, the composition comprises preferably from 5% to 30% of LAS by weight of the compact liquid detergent composition, more preferably from 7% to 25% of LAS by weight of the compact liquid detergent composition.

Surfactant Boosting Polymers

The composition of the present invention may optionally comprise polymers. Polymers suitable for the present invention can boost the efficacy of the surfactant, thus they are called surfactant boosting polymers. The most common purpose of a surfactant is to emulsify or disperse one liquid phase into another—usually the oil phase into water. When two immiscible liquids are in contact, a boundary forms between them. Increasing the interface area, results in the dispersion of one phase into another as small droplets. The lower the interfacial tension is the more one phase is emulsified into other. Therefore a low interfacial tension is correlated with cleaning efficiency in cleaning and laundering. By the term surfactant boosting polymer is meant polymers capable of decreasing the time to reach the interfacial tension equilibrium of the surfactant.

Additionally surfactant boosting polymers aid the collapse of micelles on fats. A key feature of the surfactant boosting polymer is their amphiphilicity. They have a balanced ratio of hydrophobic and hydrophilic structural elements. Hence they are firstly hydrophobic enough to absorb a hydrophobic soil and to remove it with the surfactants from a surface. Secondly it is hydrophilic enough to keep the detached hydrophobic soil in the washing and cleaning liquor and prevent it from redepositing onto the surface. For example in the polyethylene glycol polyvinyl acetate (PEG-PVAc) polymer; hydrophobic PVAc part of the PEG-PVAc polymer ensures interaction with surfactant and hydrophobic grease stains, while the hydrophilic polyethylene glycol PEG part of the PEG-PVAc polymer keeps polymer-surfactant structures dispersed in water.

The amphiphilic surfactant boosting polymers in a present invention are preferably based on water-soluble polyalkylene oxides as the hydrophilic back bone and hydrophobic side chains formed by polymerization of a vinyl ester component. Said polymers preferably have an average of one or less graft site per 50 alkylene oxide units and mean molar masses $M_w$ from 3000 to 100,000.

Most preferred surfactant boosting polymers for the present invention are known under the trade reference Sokalan PG101 (PEG-PVAc), Sokalan and Sokalan HP22 sold by BASF Aktiengesellschaft, Ludwigshafen, Germany. Surfactant boosting polymers useful here in are described in WO 2007/138053 (BASF Aktiengesellesschaft), WO/2007/138054 (Procter & Gamble Company).

The compact liquid detergent composition of the present application comprises from 0.1% to 10% surfactant boosting polymer by weight of the compact liquid detergent composition, preferably from 3% to 8% surfactant boosting polymer by weight of the compact liquid detergent composition and more preferably about 4% surfactant boosting polymer by weight of the compact liquid detergent composition.

Opacifier

The compact liquid detergent composition may comprise an opacifier. An opacifier according to the present invention is a solid, inert compound which does not dissolve in the composition and refracts, scatters or absorbs most light wavelengths.

The opacifier is preferably selected from the group consisting of styrene/acrylate latexes, titanium dioxide, tin dioxide, any forms of modified $TiO_2$, for example carbon modified $TiO_2$ or metallic doped (e.g. Platinum, Rhodium) $TiO_2$ or stannic oxide, bismuth oxychloride or bismuth oxychloride coated $TiO_2$/Mica, silica coated $TiO_2$ or metal oxide coated and mixtures thereof. Particularly preferred styrene/acrylate latexes are those available from the Rohm & Haas Company sold under the trademark Acusol. The latexes are characterized by pH of about 2 to about 3, having approximately 40% solids in water, with particle size of about 0.1 to about 0.5 micron. Specifically preferred Acusol® polymers include Acusol® OP301 (styrene/acrylate) polymer, Acusol® OP302, (Styrene/Acrylate/Divinylbenzene Copolymer), Acusol® OP303 (Styrene/Acrylamide Copolymer), Acusol® OP305 (Styrene/PEG-10 Maleate/Nonoxynol-10 Maleate/Acrylate Copolymer) and (Styrene/Acrylate/PEG-10 Dimaleate Copolymer) and mixtures thereof. Preferred species have molecular weight of from 1000 to 1 000 000, more preferably from 2000 to 500 000, most preferably from 5000 to 20 000.

The opacifier is preferably present in sufficient amount to leave the composition, in which it is incorporated, white. Where the opacifier is an inorganic opacifier (e.g. $TiO_2$, or modifications thereof) the opacifier is preferably present at a level of from 0.001% to 1%, more preferably from 0.01% to 0.5%, most preferably from 0.05% to 0.15% by weight of the compact liquid detergent composition.

Where the opacifier is an organic opacifier (e.g. styrene/acrylate latexes), the opacifier is preferably present at a level of from 0.001% to 2.5%, more preferably from 1% to 2.2%, most preferably from 1.4% to 1.8% by weight of the compact liquid detergent composition.

Antioxidant

The compact liquid detergent composition may comprise an antioxidant. The second and third compositions, when present, may also comprise antioxidant. Although not wishing to be bound by theory, the Applicants believe that the presence of antioxidant reduced or preferably stops the reaction of reactive compounds in the formula e.g. perfumes, which tend to be oxidized over time and higher temperature and which can lead to yellowing.

An antioxidant according to the present invention, is a molecule capable of slowing or preventing the oxidation of other molecules. Oxidation reactions can produce free radicals, which in turn can start chain reactions of degradation. Antioxidants terminate these chain reactions by removing the free radical intermediates and inhibiting other oxidation reactions by being oxidized themselves. As a result antioxidants are often reducing agents. The antioxidant is preferably selected from the group consisting of butylated hydroxyl toluene (BHT), butylated hydroxyl anisole (BHA), trimethoxy benzoic acid (TMBA), α, β, λ and δ tocophenol (vitamin E acetate), 6 hydroxy-2,5,7,8-tetra-methylchroman-2-carboxylic acid (trolox), 1,2, benzisothiazoline-3-one (proxel GLX), tannic acid, galic acid, Tinoguard AO-6, Tinoguard TS, ascorbic acid, alkylated phenol, ethoxyquine 2,2,4 trimethyl, 1-2-dihydroquinoline, 2,6 di or tert or butyl hydroquinone, tert, butyl, hydroxyl anisole, lignosulphonic acid and salts thereof, benzofuran, benzopyran, tocopherol sorbate, butylated hydroxyl benzoic acid and salts thereof, galic acid and its alkyl esters, uric acid, salts thereof and alkyl esters, sorbic acid and salts thereof, dihydroxy fumaric acid and salts thereof, and mixtures thereof. Preferred antioxidants are those selected from the group consisting of alkali and alkali earth metal sulfites and hydrosulfites, more preferably sodium sulfite or hydrosulfite.

The antioxidant is preferably present at a level of from 0.01% to 2%, more preferably from 0.1% to 1%, most preferably from 0.3% to 0.5% by weight of the compact liquid detergent composition.

Where inorganic opacifier is used, the opacifier and antioxidant are preferably present at a ratio of from 0.1 to 0.5, more preferably from 0.12 to 0.35. Whereas, where an organic opacifier is used, opacifier and antioxidant are preferably present at a ratio of from 2 to 6, more preferably from 3 to 5.

Rheology Modifier

In a preferred embodiment the compact liquid detergent composition comprises a rheology modifier. The rheology modifier is selected from the group consisting of non-polymeric crystalline, hydroxy-functional materials, polymeric rheology modifiers which impart shear thinning characteristics to the aqueous liquid matrix of the composition. Crystalline, hydroxy-functional materials are rheology modifiers which form thread-like structuring systems throughout the matrix of the composition upon in situ crystallization in the matrix. Specific examples of preferred crystalline, hydroxyl-containing rheology modifiers include castor oil and its derivatives. Especially preferred are hydrogenated castor oil derivatives such as hydrogenated castor oil and hydrogenated castor wax. Commercially available, castor oil-based, crystalline, hydroxyl-containing rheology modifiers include THIXCIN® from Rheox, Inc. (now Elementis). Polymeric rheology modifiers are preferably selected from polyacrylates, polymeric gums, other non-gum polysaccharides, and combinations of these polymeric materials. Preferred polymeric gum materials include pectine, alginate, arabinogalactan (gum Arabic), carrageenan, gellan gum, xanthan gum, guar gum and mixtures thereof.

Fabric Care Benefit Agents

The compact liquid detergent compositions may comprise a fabric care benefit agent. As used herein, "fabric care benefit agent" refers to any material that can provide fabric care benefits such as fabric softening, color protection, pill/fuzz reduction, anti-abrasion, anti-wrinkle, and the like to garments and fabrics, particularly on cotton and cotton-rich garments and fabrics, when an adequate amount of the material is present on the garment/fabric. Non-limiting examples of fabric care benefit agents include cationic surfactants, silicones, polyolefin waxes, latexes, oily sugar derivatives, cationic polysaccharides, polyurethanes, fatty acids and mixtures thereof. Fabric care benefit agents when present in the compact liquid detergent composition, are suitably at levels of up to 30% by weight of the compact liquid detergent composition, more typically from 1% to 20%, preferably from 2% to 10%.

Detersive Enzymes

Suitable detersive enzymes for use herein include protease, amylase, lipase, cellulase, carbohydrase including mannanase and endoglucanase, and mixtures thereof. Enzymes can be used at their art-taught levels, for example at levels recommended by suppliers such as Novo and Genencor. Typical levels in the compact liquid detergent compositions are from 0.0001% to 5%. When enzymes are present, they can be used at very low levels, e.g., from 0.001% or lower, in certain embodiments of the invention; or they can be used in heavier-duty laundry detergent formulations in accordance with the invention at higher levels, e.g., 0.1% and higher. In accordance with a preference of some consumers for "non-biological" detergents, the present invention includes both enzyme-containing and enzyme-free embodiments.

Deposition Aid

As used herein, "deposition aid" refers to any cationic polymer or combination of cationic polymers that significantly enhance the deposition of a fabric care benefit agent onto the fabric during laundering. Preferably, the deposition aid is a cationic or amphoteric polymer. The amphoteric polymers of the present invention will also have a net cationic charge, i.e.; the total cationic charges on these polymers will exceed the total anionic charge. Nonlimiting examples of deposition enhancing agents are cationic polysaccharides, chitosan and its derivatives and cationic synthetic polymers. Preferred cationic polysaccharides include cationic cellulose derivatives, cationic guar gum derivatives, chitosan and derivatives and cationic starches.

Builder

The compact liquid detergent compositions may optionally comprise a builder. Suitable builders include polycarboxylate builders include cyclic compounds, particularly alicyclic compounds, such as those described in U.S. Pat. Nos. 3,923,679; 3,835,163; 4,158,635; 4,120,874 and 4,102,903. Particularly preferred are citrate builders, e.g., citric acid and soluble salts thereof (particularly sodium salt). Other preferred builders include aluminosilicates such as zeolite A, B or MAP; fatty acids or salts, preferably sodium salts, thereof, preferably C12-C18 saturated and/or unsaturated fatty acids; and alkali or alkali earth metal carbonates preferably sodium carbonate.

The compact liquid detergent composition of the present application comprises from 2% to 20% fatty acids by weight of the compact liquid detergent composition, preferably from 5% to 15% fatty acids by weight of the compact liquid detergent composition and most preferably from 6% to 10% fatty acids by the weight of the compact liquid detergent composition.

Bleaching System

Bleaching agents suitable herein include chlorine and oxygen bleaches, especially inorganic perhydrate salts such as sodium perborate mono- and tetrahydrates and sodium percarbonate optionally coated to provide controlled rate of release (see, for example, GB-A-1466799 on sulfate/carbonate coatings), preformed organic peroxyacids and mixtures thereof with organic peroxyacid bleach precursors and/or transition metal-containing bleach catalysts (especially manganese or cobalt). Inorganic perhydrate salts are typically incorporated at levels in the range from 1% to 40% by weight, preferably from 2% to 30% by weight and more preferably from 5% to 25% by weight of compact liquid detergent composition. Peroxyacid bleach precursors preferred for use herein include precursors of perbenzoic acid and substituted perbenzoic acid; cationic peroxyacid precursors; peracetic acid precursors such as TAED, sodium acetoxybenzene sulfonate and pentaacetylglucose; pernonanoic acid precursors such as sodium 3,5,5-trimethylhexanoyloxybenzene sulfonate (iso-NOBS) and sodium nonanoyloxybenzene sulfonate (NOBS); amide substituted alkyl peroxyacid precursors (EP-A-0170386); and benzoxazin peroxyacid precursors (EP-A-0332294 and EP-A-0482807). Bleach precursors are typically incorporated at levels in the range from 0.5% to 25%, preferably from 1% to 10% by weight of composition while the preformed organic peroxyacids themselves are typically incorporated at levels in the range from 0.5% to 25% by weight, more preferably from 1% to 10% by weight of compact liquid detergent composition. Bleach catalysts preferred for use herein include the manganese triazacyclononane and related complexes (U.S. Pat. No. 4,246,612, U.S. Pat. No. 5,227,084); Co, Cu, Mn and Fe bispyridylamine and related complexes (U.S. Pat. No. 5,114,611); and pentamine acetate cobalt(III) and related complexes (U.S. Pat. No. 4,810,410).

Whitening Agent

A compact liquid detergent composition may comprise a whitening agent. Such dyes have been found to exhibit good tinting efficiency during a laundry wash cycle without exhibiting excessive undesirable build up during laundering. The whitening agent is included in the total laundry detergent composition in an amount sufficient to provide a tinting effect to fabric washed in a solution containing the detergent. In one embodiment, a multi-compartment pouch comprises, by weight, from 0.0001% to 1%, more preferably from 0.0001% to 0.5% by weight of the compact liquid detergent composition, and even more preferably from 0.0001% to 0.3% by weight of the compact liquid detergent composition.

Pearlescent Agent

The compact liquid detergent compositions of the present invention may comprise a pearlescent agent. Said pearlescent agent may be organic or inorganic, but is preferably inorganic. Most preferably the pearlescent agent is selected from mica, $TiO_2$ coated mica, bismuth oxychloride or mixtures thereof.

Perfume

Perfumes are preferably incorporated into the compact liquid detergent compositions of the present invention. The perfumes may be prepared as a premix liquid, may be linked with a carrier material, such as cyclodextrin or may be encapsulated. When encapsulated the perfumes are preferably encapsulated in a melamine/formaldehyde coating.

Other Adjuncts

Examples of other suitable cleaning adjunct materials include, but are not limited to; enzyme stabilizing systems; scavenging agents including fixing agents for anionic dyes, complexing agents for anionic surfactants, and mixtures thereof; optical brighteners or fluorescers; soil release polymers; dispersants; suds suppressors; dyes; colorants; hydrotropes such as toluenesulfonates, cumenesulfonates and naphthalenesulfonates; color speckles; colored beads, spheres or extrudates; clay softening agents and mixtures thereof.

Composition Preparation

The compact detergent compositions herein can generally be prepared by mixing the ingredients together. If a pearlescent material is used it should be added in the late stages of mixing. If a rheology modifier is used, it is preferred to first form a pre-mix within which the rheology modifier is dispersed in a portion of the water and optionally other ingredients eventually used to comprise the compositions. This premix is formed in such a way that it forms a structured liquid. To this structured pre-mix can then be added, while the premix is under agitation, the surfactant(s) and essential laundry adjunct materials, along with water and whatever optional detergent composition adjuncts are to be used.

Pouch Material

When the compact liquid detergent composition is packed into the pouches, the pouch is preferably made of a film material which is soluble or dispersible in water, and has a water-solubility of at least 50%, preferably at least 75% or even at least 95%. The water-solubility is measured by the method set out here after using a glass-filter with a maximum pore size of 20 microns: 50 grams±0.1 gram of pouch material is added in a pre-weighed 400 ml beaker and 245 ml±1 ml of distilled water is added. This is stirred vigorously on a magnetic stirrer set at 600 rpm, for 30 minutes. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Preferred pouch materials are polymeric materials, preferably polymers which are formed into a film or sheet. The pouch material can, for example, be obtained by casting, blow-moulding, extrusion or blown extrusion of the polymeric material, as known in the art.

Preferred polymers, copolymers or derivatives thereof suitable for use as pouch material are described in WO03/045812 (Procter & Gamble Company), WO04/085586 (Procter & Gamble Company) and WO07/130,684 (Procter & Gamble Company).

Preferably, the level of polymer in the pouch material, for example a PVA polymer, is at least 60%. The polymer can have any weight average molecular weight, preferably from 1000 to 1,000,000, more preferably from 10,000 to 300,000 yet more preferably from 20,000 to 150,000.

Mixtures of polymers can also be used as the pouch material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights.

Naturally, different film material and/or films of different thickness may be employed in making the compartments of the present invention. A benefit in selecting different films is that the resulting compartments may exhibit different solubility or release characteristics.

Most preferred pouch materials are PVA films known under the trade reference Monosol M8630, as sold by Mono-Sol LLC of Gary, Ind., US, and PVA films of corresponding solubility and deformability characteristics. Other films suitable for use herein include films known under the trade reference PT film or the K-series of films supplied by Aicello, or VF-HP film supplied by Kuraray.

The pouch material herein can also comprise one or more additive ingredients. For example, it can be beneficial to add plasticisers, for example glycerol, ethylene glycol, diethyleneglycol, propylene glycol, sorbitol and mixtures thereof. Other additives include functional detergent additives to be delivered to the wash water, for example organic polymeric dispersants, etc.

For reasons of deformability pouches or pouch compartments containing a component which is liquid will preferably contain an air bubble having a volume of up to 50%, preferably up to 40%, more preferably up to 30%, more preferably up to 20%, more preferably up to 10% of the volume space of said compartment.

Process for Making the Water-Soluble Pouch

The process of making the water-soluble pouch may be made using any suitable equipment and method. Single compartment pouches are made using vertical, but preferably horizontal form filling techniques commonly known in the art.

The process for making a water-soluble pouch has been described in EP 1504994 (Procter & Gamble Company) and WO02/40351 (Procter & Gamble Company). The process for making a multi-compartment water-soluble pouch has been described in co-pending patent application 09161692.0 filed June 2009 (Procter & Gamble Company).

Secondary Packaging

The multi-compartment pouches of the present invention are preferably further packaged in an outer package. Said outer package may be a see-through or partially see-through container, for example a transparent or translucent bag, tub, carton or bottle. The pack can be made of plastic or any other suitable material, provided the material is strong enough to protect the pouches during transport. This kind of pack is also very useful because the user does not need to open the pack to see how many pouches there are left. Alternatively, the pack can have non-see-through outer packaging, perhaps with indicia or artwork representing the visually-distinctive contents of the pack.

Process of Washing

The compact liquid detergent of the present invention is suitable for laundry cleaning applications. The compact liquid detergent is suitable for hand or machine washing conditions. When machine washing, the compact liquid detergent may be delivered from the dispensing drawer or may be added directly into the washing machine drum either in a form of water-soluble pouches or in a form of compact liquid.

EXAMPLES

The following are examples of the pouch products of the present invention:

Formulation:

| Ingredient Name | Composition A WT % | Composition B WT % |
|---|---|---|
| Linear Alkyl benzene sulfonic acid | 16 | 14 |
| C12-14 alkyl ethoxy 3-sulfate MEA salt | 10 | 13 |
| C12-14 alkyl 7-ethoxylate | 9 | 15 |
| C12-18 Fatty acid | 15 | 8 |
| Sodium-Diethylenetriaminepentaacetate | 0.5 | 0.7 |
| H-EDDS[1] | 0.7 | |
| Na-EDDS | — | 1.0 |
| Enzymes | 2.3 | 2.3 |
| Solvent | 15 | 14 |
| Buffer (Monoethanol amine) | To pH 7.5 | To pH 7.5 |
| Water | 10 | 15 |
| Miscellaneous/Minors | to 100 | to 100 |

[1]H-EDDS: Ethylenediamine-N,N'-disuccinic acid

Performance:

The performance of the chelants were measured on wine and tea. Wine and tea stains were applied to cotton and obtained from EMC (US). Stains and ballast load consisting of 0.5 kg of T-shirt was added to a MiniWasher representing a medium US wash conditions. The wash water was set at 32.2° C.±1° C. and 6 gpg (1 mmol/L) hardness and the rinse water was set at 15.5° C.±1° C. The water volume was 15 liters and wash time 12 minutes.

The stains and the ballast were dried at the end of each cycle under high speed and high heat with cool down cycle. The results were then analyzed by image analysis which is a method that enables to calculate the amount of stain that is removed. Stains are imaged before washing and after washing. The imaging calculates the amount of stain removal index (SRI). SRI of 100 means complete removal and SRI of zero is no removal.

The Laundry Image Analysis system (Merlin image analysis system) measures stain removal on technical stain swatches. The system utilizes a video camera to acquire color images of swatches. An image of the swatch is taken before and after it is washed. The acquired image is then analyzed by computer software (Global R&D computing). The software compares the unwashed stain to the washed stain, as well as the unwashed fabric to the washed fabric and produces five figures of merit which describe stain removal. The data are then analyzed statistically to determine statistically significant differences between the detergent performances.

The stain removal index uses the initial fabric as the reference against which to measure color differences between unwashed and washed stains. A higher value indicates a better cleaning and stain removal thus a better detergent. The standard deviation is 1.

| | Stain Removal Index | Stain Removal Index |
|---|---|---|
| Nil Chelant | 54.6 | 22.8 |
| Chelant | Wine | Tea |
| Na-DTPA - 1ppm | 55.2 | 27.6 |
| Na-DTPA - 2 ppm | 55.8 | 29.0 |

-continued

| | | |
|---|---|---|
| Na-DTPA - 3 ppm | 56.4 | 27.1 |
| Na-EDDS - 1 ppm | 58.3 | 28.2 |
| Na-EDDS - 2 ppm | 59.0 | 29.3 |
| Na-EDDS - 3 ppm | 56.8 | 26.1 |
| Na-DTPA (0.5 ppm) Na-EDDS (0.5 ppm) | 57.1 | 28.7 |
| Na-DTPA (1 ppm) Na-EDDS (1 ppm) | 58.9 | 32.4 |
| Na-DTPA (1.5 ppm) Na-EDDS (1.5 ppm) | 59.9 | 33.9 |

Product Stability:

Products (I through III) were prepared by combining Composition C and the 3 different chelant combinations. The products (75 g) were stored for 4 weeks at 4° C., 20° C. and 35° C. in a Glass Jar (100 mL contenance). The product stability was then assessed visually. If there is a visual precipitate or a product phase split, the stability is considered Fail. Stability is considered Pass if there is no signs of changes during the storage period.

| Ingredient Name | Composition C WT % |
|---|---|
| Linear Alkyl benzene sulfonic acid | 16 |
| C12-14 alkyl ethoxy 3 sulfate MEA salt | 10 |
| C12-14 alkyl 7-ethoxylate | 9 |
| C12-18 Fatty acid | 15 |
| Enzymes | 2.3 |
| Solvent | 15 |
| Monoethanol amine | To pH 7.5 |
| Water | 10 |
| Miscellaneous/Minors | to 100 |

| Product | Chelant | Pass/Fail |
|---|---|---|
| I | Na-DTPA - 0.7% | Pass |
| II | Na-DTPA - 1.4% | Fail |
| III | Na-EDDS/Na-DTPA (0.7%/0.7 %) | Pass |

The stability test shows the synenergy between the chelants DTPA and EDDS. A compact liquid detergent composition comprising 0.7% of Na-DTPA is stable, however it does not provide desired cleaning efficacy. By increasing the quantity of Na-DTPA to the effective level, the composition does not meet the stability requirements. Combination of 0.7% Na-EDDS and 0.7% Na-DTPA does provide desired cleaning efficacy and meets the stability requirements.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cite in the Detailed Description of the Invention are, in relevant part, incorporated herein by reference, the citation of any document is not to be construed as an admission that it is prior art with respect to the present invention. To the extent that any meaning or definition of a term in this document conflicts with any meaning or definition of the same term in a document incorporated by reference, the meaning or definition assigned to the term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A compact liquid detergent composition comprising from 1% to 80% surfactant by weight of the composition, from 7% to 20% water by weight of the composition, and from 0.05% to 5% chelant mixture by weight of the composition, wherein first chelant is sodium salt of Ethylenediamine-N,N'-disuccinic acid, and second chelant is sodium salt of diethylene triamine pentaacetate, wherein the chelant mixture comprises a weight ratio of about 1:1 of the sodium salts of diethylene triamine pentaacetate and Ethylenediamine-N,N'-disuccinic acid, and further wherein the compact liquid detergent composition is encapsulated in a water-soluble pouch.

2. A compact liquid detergent composition according to claim 1 wherein said liquid detergent composition comprises from 0.1% to 4% chelant mixture by weight of the composition.

3. A compact liquid detergent composition according to claim 1 wherein said liquid detergent composition comprises from 0.5% to 2% chelant mixture by weight of the composition.

4. A compact liquid detergent composition according to claim 1 wherein said compact liquid detergent composition comprises an opacifier and an antioxidant.

5. A compact liquid detergent composition according to claim 1 wherein the water-soluble pouch comprises two or more compartments, wherein the second compartment comprises a coloring agent and does not comprise opacifier.

* * * * *